US008087771B2

(12) United States Patent
Thayer et al.

(10) Patent No.: US 8,087,771 B2
(45) **Date of Patent: *Jan. 3, 2012**

(54) DUAL BLADE RELEASE AGENT APPLICATION APPARATUS

(75) Inventors: Bruce E. Thayer, Webster, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 606 days.

This patent is subject to a terminal disclaimer.

(21) Appl. No.: 12/201,039

(22) Filed: Aug. 29, 2008

(65) Prior Publication Data

US 2010/0053292 A1 Mar. 4, 2010

(51) Int. Cl.
*B41J 2/01* (2006.01)
*G03G 21/00* (2006.01)

(52) U.S. Cl. ..... 347/103; 347/33; 399/350; 399/345

(58) Field of Classification Search ..... 347/103, 347/88, 99, 101, 33; 399/345, 346, 350
See application file for complete search history.

(56) References Cited

U.S. PATENT DOCUMENTS 5,208,639 A 5/1993 Thayer et al.
5,264,904 A 11/1993 Audi et al.
5,546,165 A 8/1996 Rushing et al.
5,610,699 A 3/1997 Yu et al.
5,778,296 A 7/1998 van der Steen et al.
6,438,329 B1 8/2002 Budnik et al.
7,715,776 B2 * 5/2010 Thayer et al. ..... 399/345
2003/0232262 A1 12/2003 Yamada et al.
2006/0001911 A1 1/2006 Viassolo et al.
2006/0115285 A1 6/2006 Thayer
2007/0020005 A1 1/2007 Shigezaki et al.
2007/0139496 A1 6/2007 Leighton et al.
2007/0182800 A1 8/2007 Fioravanti et al.
2009/0304406 A1 * 12/2009 Thayer et al. ..... 399/71
2009/0304407 A1 * 12/2009 Thayer et al. ..... 399/71
2010/0053261 A1 * 3/2010 Thayer et al. ..... 347/33
2010/0054830 A1 * 3/2010 Thayer et al. ..... 399/350

* cited by examiner

*Primary Examiner* — Manish S Shah
(74) *Attorney, Agent, or Firm* — Fay Sharpe LLP

(57) ABSTRACT

A application apparatus for metering release agent onto an image forming device moving surface, such as a Solid Ink Jet drum. The application apparatus includes a blade positioning mechanism with first and second links each having three pivot connections for pivotally connecting first and second blades together in mutually exclusive cooperative movement alternating between a common working position at a first location and respective suspended positions. The application apparatus can include a doctor blade arrangement in which the blades are disposed in a doctor blade orientation in the working position. The application apparatus can include a wiper blade arrangement in which the blades are disposed in a wiper blade orientation in the working position. The first and second blades form similar blade holder angles, blade deflection angles and Working Angles when occupying the working position.

20 Claims, 6 Drawing Sheets

DUAL BLADE RELEASE AGENT APPLICATION APPARATUS

CROSS REFERENCE TO RELATED APPLICATIONS

Attention is directed to co-pending application: U.S. application Ser. No. 12/021,500 filed Jan. 29, 2008, entitled "DUAL BLADE CLEANING SYSTEM" the disclosure found in this co-pending application is hereby incorporated herein by reference in its entirety.

BACKGROUND

Disclosed in embodiments herein are systems for metering and/or cleaning release agent on an image forming machine moving surface, and more specifically a dual blade application apparatus utilizing three-pivot links for moving the blades between separate suspended positions and a common working position.

Image forming machines such as solid ink jet (SIJ) image forming machines generally use an electronic form of an image to distribute ink melted from a solid ink stick or pellet in a manner that reproduces the electronic image. In some solid ink jet imaging systems, the electronic image may be used to control the ejection of ink directly onto a media sheet. In other solid ink jet imaging systems, the electronic image is used to eject ink onto an intermediate imaging member. A media sheet is then brought into contact with the intermediate imaging member in a nip formed between the intermediate member and a transfer roller. The heat and pressure in the nip helps transfer the ink image from the intermediate imaging member to the media sheet.

One issue arising from the transfer of an ink image from an intermediate imaging member to a media sheet is the transfer of some ink to other machine components. For example, ink may be transferred from the intermediate imaging member to a transfer roller when a media sheet is not correctly registered with the image being transferred to the media sheet. The pressure and heat in the nip may cause a portion of the ink to adhere to the transfer roller, at least temporarily. The ink on the transfer roller may eventually adhere to the back side of a subsequent media sheet. If duplex printing operations are being performed, the quality of the image on the back side is degraded by the ink that is an artifact from a previous processed image.

To address these problems, various release agent applicators have been designed, often as part of an image drum maintenance system. These release agent applicators provide a coating of a release agent, such as silicone oil, onto the intermediate imaging member moving surface to reduce the undesired build-up of ink. It is desired to control the amount of release agent applied, since using of too much release agent causes undesirable streaks, also known as oil streaks, on the output prints.

The present application provides a new and improved apparatus for cleaning and/or metering a release agent onto an image forming device moving surface which overcomes these above-described problems.

DETAILED DESCRIPTION

Figure 1:
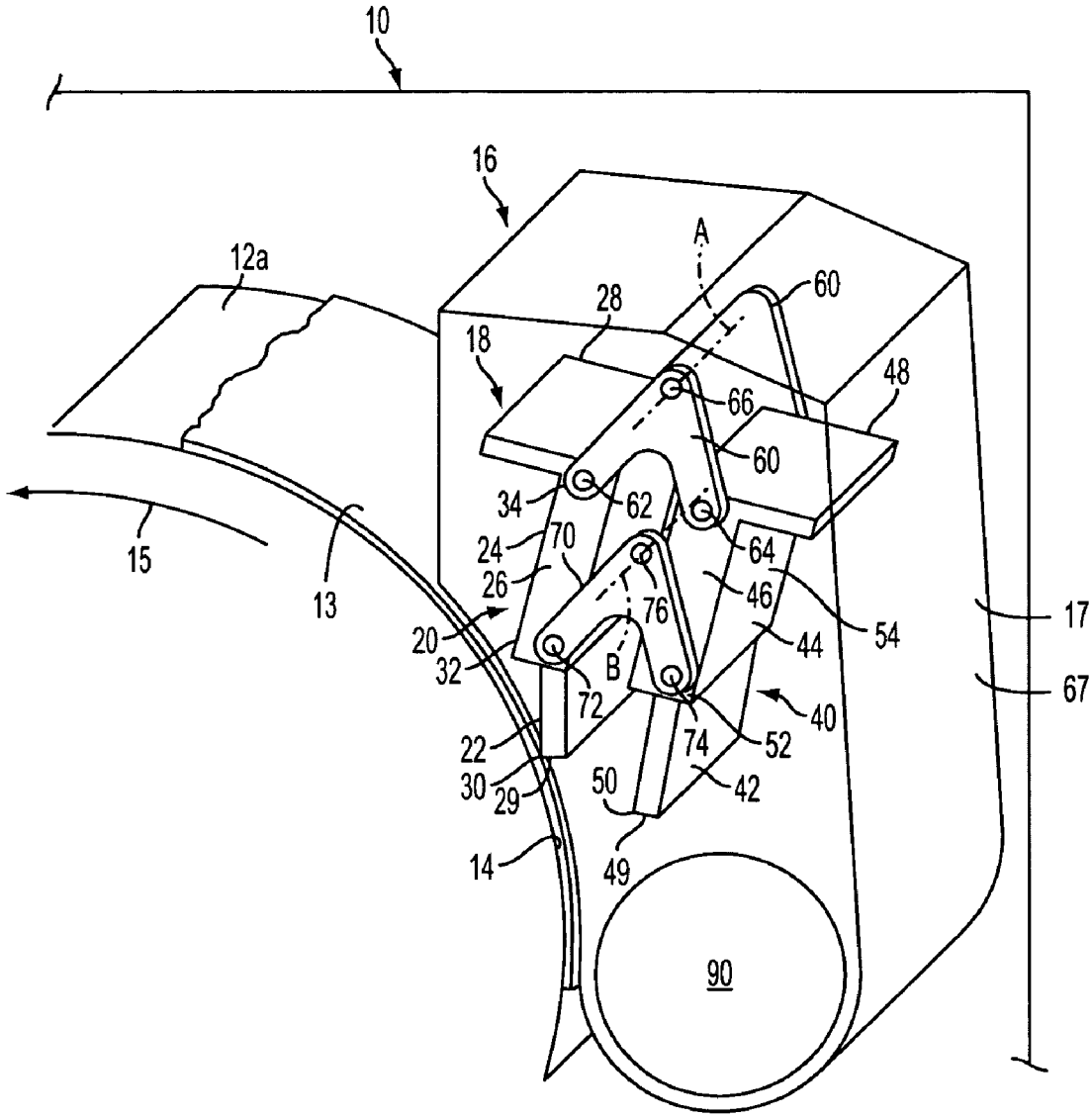
FIG. 1 is a perspective view illustrating the application apparatus having a doctor blade arrangement as described herein with a first blade disposed in the working position.

Referring now to FIG. 1, an image forming machine, shown generally at 10, includes a moving surface 14 adapted to receive the controlled application of a release agent, a portion of which is shown at 13. In one example, the image forming machine 10 is a Solid Ink Jet (SIJ) printer including a rotating SIJ drum 12*a* having a cylindrical outer surface 14 rotating in a rotational direction of operation 15. The drum 12*a* can also be an imaging member, such as a photoreceptor, or a glossing drum, or other rotating cylindrical surface receiving an application of release agent. Other examples of applicable release agent 13 receiving moving surfaces, moving in an operational direction 15, can include flat moving imaging members 12*b*, such as rigid photoreceptors, or moving belts 12*c*, such as photoreceptor belts, are illustrated generally using the surfaces 14 depicted in FIGS. 3, 4, 7 and 8. These surfaces 14 can be used in other image forming machines 10, such as xerographic copiers, printers, multifunction machines, and the like.

The image forming device 10 also includes a blade engagement apparatus, also referred to as a release agent application apparatus, shown generally at 16, for applying a controlled amount of release agent 13 to the surface 14 in an operation referred to herein as metering. The application apparatus 16 can be contained in a removable cartridge housing 17, if so desired, such as for example part of a cartridge, also referred to a Drum Maintenance Unit (DMU). The cartridge 17 can be removed from the image forming device 10 and discarded when its useful life has been depleted.

The application apparatus 16 includes a blade positioning mechanism 18 connected to a pair of metering blades, including a first blade 20 and a second blade 40. The blade positioning mechanism 18 moves the blades 20 and 40 into a working position, also referred to as an operational position, in engagement with surface 14 and applies application forces to the blades for applying a thin, metered amount of release agent 13 onto the surface as shall be described in further detail below.

The first blade 20 includes blade member 22 extending from a blade holder 24 and terminating in an end 29. The second blade 40 includes blade member 42 extending from a blade holder 44 and terminating in an end 49. The blade holders 24, 44, formed of aluminum, steel or other suitably rigid material, can be connected to, or integrated with, the blade members 22, 42 to evenly distribute the application forces applied by the blade positioning mechanism 18 along the length of the blades 20, 40.

Figure 3:
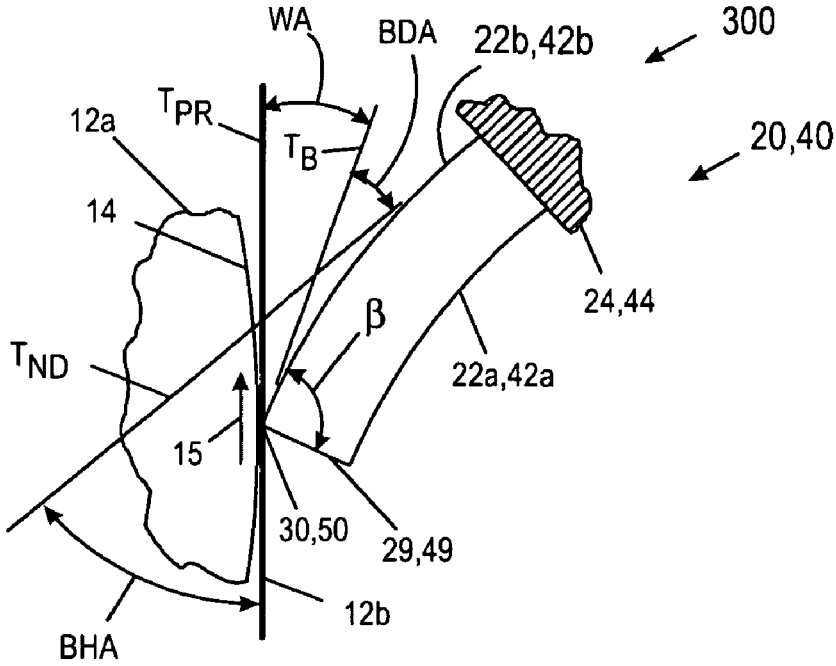
FIG. 3 illustrates the doctor blade orientation of the first and second blades disposed in the working position against flat and cylindrical moving surfaces.

Referring now to FIGS. 1 and 3, the blade members 22, 42 include a metering tip, also referred to as a metering edge, 30 and 50 respectively, which is pushed against, or towards, the moving surface 14 for metering the release agent 13 onto the surface when the blades 20, 40 are moved into the working position as shall be described in further detail below. The metering tips 30, 50 are formed between the blade member sides 22*b*, 42*b* and ends 29, 49 which meet at an angle β. For the purposes of the examples provided herein, β is 90 degrees, though it can be different. The metering tips 30, 50 can be coated with PMMA, SureLube, toner or other initial blade lubricant to prevent blade flip as the blades are moved into the working position.

The blade members 22, 42 have upstream sides 22*a*, 42*a* and downstream sides 22*b*, 42*b* as referenced to the operational direction of travel 15 of surface 14. The blade members 22, 42 can be formed of a compliant material, such as polyurethane, enabling the blade members to bend or deflect as the positioning mechanism 18 moves them into the working position and applies applications forces which generate a blade load applied by the blade members at the surface 14 for metering the release agent 13 between the blade tips 30, 50 and the surface.

Figure 2:
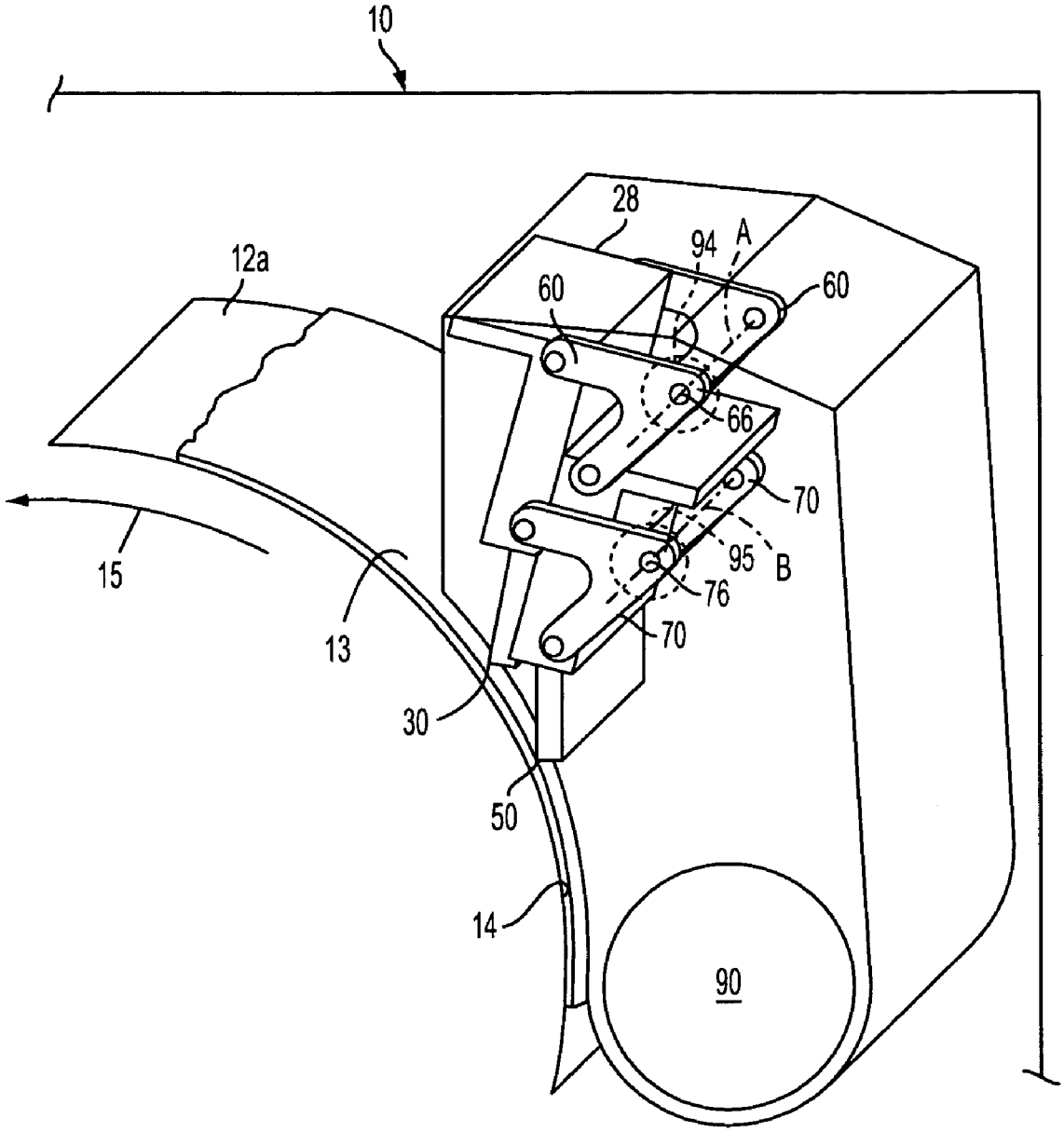
FIG. 2 is a perspective view illustrating the application apparatus having a doctor blade arrangement as described herein with a second blade disposed in the working position.

Referring now to FIGS. 1 and 2, the blade holders 24, 44 are elongated members having oppositely disposed lateral ends 26, 46 and 28, 48 respectively. The blade holders 24, 44 are disposed adjacent the moving surface 14, extending transversely across it with respect to the operational direction 15. The blade holders 24, 44 have proximate portions 32, 52 and distal portions 34, 54, respectively, as referenced in relation to the adjacent photoreceptor 12.

The blade positioning mechanism 18 includes a pair of first links 60 formed of a rigid material, such as metal, plastic, composites or the like. The first links 60 are connected to opposite lateral ends of the blades 20 and 40 to couple the blade together for moving one blade member into the working position while simultaneously moving the other blade into a corresponding suspended position, as shall be described in further detail below. The first links 60 are similar, unless stated below, and thus only one first link is shown in detail for the purposes of clarity. The first links 60 include first pivot connections 62 pivotally connected to the distal portions 34 of the oppositely disposed lateral ends 26 and 28 of the first blade holder 24. The first links 60 also include second pivot connections 64 pivotally connected to the distal portions 54 of the lateral ends 46 and 48 of the second blade holder 44. The first links 60 also include third pivot connections 66 pivotally connected to one or more frame members 67, enabling the first links to rotate about a fixed axis A at the third pivot connection while preventing non-pivoting displacement of the first links with respect to the frame. The frame 67 can be part of the cartridge 17, or a support member attached to the image forming device 10.

The blade positioning mechanism 18 also includes a pair of second links 70 formed of a rigid material, such as metal, plastic, composites or the like. The second links 70 are connected to opposite lateral ends of the blades 20 and 40 to also couple the blade members together as shall be described in further detail below. The second links 70 are similar, unless stated below, and thus only one second link is shown in detail for the purposes of clarity. The second links 70 include first pivot connections 72 pivotally connected to the proximate portions 32 of the oppositely disposed lateral ends 26 and 28 of the first blade holder 24. The second links 70 also include second pivot connection 74 pivotally connected to the proximate portions 52 of the lateral ends 46 and 48 of the second blade holder 44. The second links 70 also include third pivot connections 76 pivotally connected to one or more of the frame members 67', enabling the second links to rotate about a fixed axis B at the third pivot connection while preventing non-pivoting displacement of the second links with respect to the frame. The frame members 67' can be the same as those described above at 67, or different ones.

The first and second link pivot connections 62, 64, 66, 72, 74, and 76 can be formed by fasteners, such as rivets, bolts or the like extending from the blade holders 24, 44 or frame 67, and through apertures in the first and second links 60, 70, or in other manners which enable relative rotation at the connections. The pivot connections 62, 64 and 66 are disposed in a triangular arrangement on the first links 60, and the pivot connections 72, 74 and 76 are disposed in a triangular arrangement on the second links 70. The first and second links 60, 70 can be V-shaped, each having 2 legs extending from the third pivot connections 66, 76 with the first pivot connections 62, 72 disposed at the end of one leg and second pivot connections 64, 74 disposed at the end of the other leg. Such an arrangement can enable the links 60, 70 to be located close to each other without interfering in their movement. Other examples of the links 60, 70 can have triangular shapes with the pivot connections disposed at the vertices thereof. Other examples of the links may have other shapes.

The application apparatus 16 includes an actuator 94, as shown in FIG. 2, connected to one of the first links 60 to rotate it about the third pivot connection 66. The actuator 94 can be a solenoid, or stepper motor, or some other actuator capable of rotating the first link 60 at connection 66. The actuator 94 can be disposed at the third pivot connection 66, or it can be disposed in another location and connected to the first link 60, such as by gears, arms, etc. so as to provide rotational movement to the first link 60 for rotation about axis A disposed at the third pivot connection 66. Other actuator arrangements capable of rotating the first and second links 60 and 70 about the third pivot connections, 66 and 76 respectively, are contemplated including, but not limited to using an actuator, shown at 95, connected to one of the second links 70 to rotate it about the third pivot connection 76, or two actuators 94 connected to each of the first links 60, or two actuators 95 connected to each of the second links 70, for rotating the links about the third pivot connections 66 and 76 respectively. The first or second link driven for rotation by the actuator 94 or 95 can be referred to as the drive link, whereas the undriven link can be referred to as the follower link. The actuator can be controlled during operation by a controller as described below and in further detail in the co-pending application U.S. application Ser. No. 12/201,140 filed concurrently herewith, entitled "SYSTEM AND METHOD OF ADJUSTING BLADE LOADS FOR BLADES ENGAGING IMAGE FORMING MACHINE MOVING SURFACES" the disclosure of which is incorporated herein by reference in its entirety.

The operation of the application apparatus 16 shall now be described. For the purposes of simplicity, an example of the application apparatus 16 is provided using one actuator 94 connected to one of the first links 60, though it should be appreciated that operational movement of the blades 20, 40 as described herein can be extended to other arrangements of actuators as contemplated above.

The actuator 94 can rotate link 60 in a first rotational direction (counter clockwise for the inboard link 60 shown in FIG. 1) about the pivot axis A at the third pivot connection 66 moving the first blade 20 towards the surface 14 and into the working position in engagement with surface as shown in FIG. 1. The first blade 20 can now be referred to as the operational blade. The second bade 40 is simultaneously moved away from the surface 14 in a suspended position and it can be referred to as the non-operational blade.

While blade 20 is in the working position, the actuator 94 can continue to rotate links 60 in the first direction to move the first blade holder 24 in a direction towards the surface 14 to increase the blade load against the surface at the blade edge 30 and can rotate the link in the second direction to move the first blade holder 24 in a direction away from the surface 14 to decrease the blade load on the surface 14, as described in further detail below. A larger blade load applies a thinner amount release agent to the surface 14, whereas a smaller blade load applies a thicker amount of release agent.

At the end of the operational life of the first blade 20, the used blade is withdrawn from the working position and moved to a suspended position away from surface 14 becoming the non-operational blade, and the second blade 40 is placed into the working position in engagement with surface 14 for use as the operational blade as shown in FIG. 2. The actuator 94 provides actuation forces to the first link 60 of the Blade Positioning Mechanism 16 providing pivoting movement to the pair of first links 60 in a second direction of rotation (clockwise for the inboard link 60 as shown in FIG. 2) about the third pivot connections 66 at axis A. As the first links 60 are rotated about axis A in the second direction of rotation, the second links 70 also rotate at the third pivot connections 77 about axis B in the same direction of rotation.

While the second blade 40 is in the working position, the actuator 94 can continue to rotate links 60 in the second direction to move the second blade holder 44 in a direction towards the surface 14 to increase the blade load against the surface at the blade edge 50 for applying a thinner layer of release agent. Alternatively, while blade 40 is in the working position, the actuator 94 can rotate the link in the first direction to move the second blade holder 44 in a direction away from the surface 14 to decrease the blade load on the surface 14 at edge 50 for applying a thicker layer of release agent as described in further detail below.

Thus upon actuation of the actuator 94, the Blade Positioning Mechanism alternately moves the blades 20 and 40 between separate suspended non-operational positions, disposed at different locations, and the common working position, disposed at a single location, for metering the release agent 13 onto the surface 14. Only one of the blades 20 and 40 will be the operational blade disposed in the working position at any one time, during which time the non-operational blade will be disposed in its respective suspended position with the blade member separated from the moving surface 14.

Figure 4:
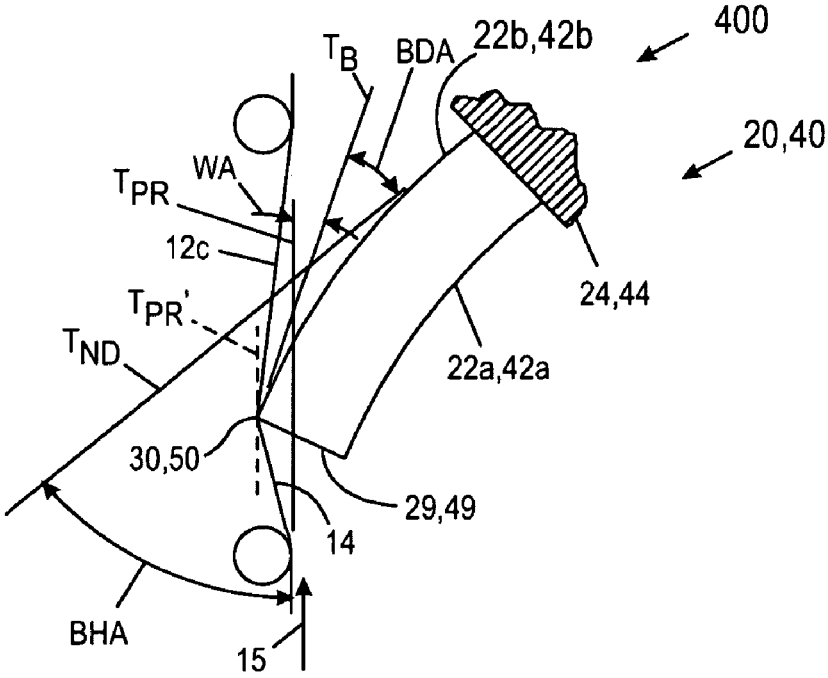
FIG. 4 illustrates the doctor blade orientation of the first and second blades disposed in the working position a moving belt.
Figure 5:
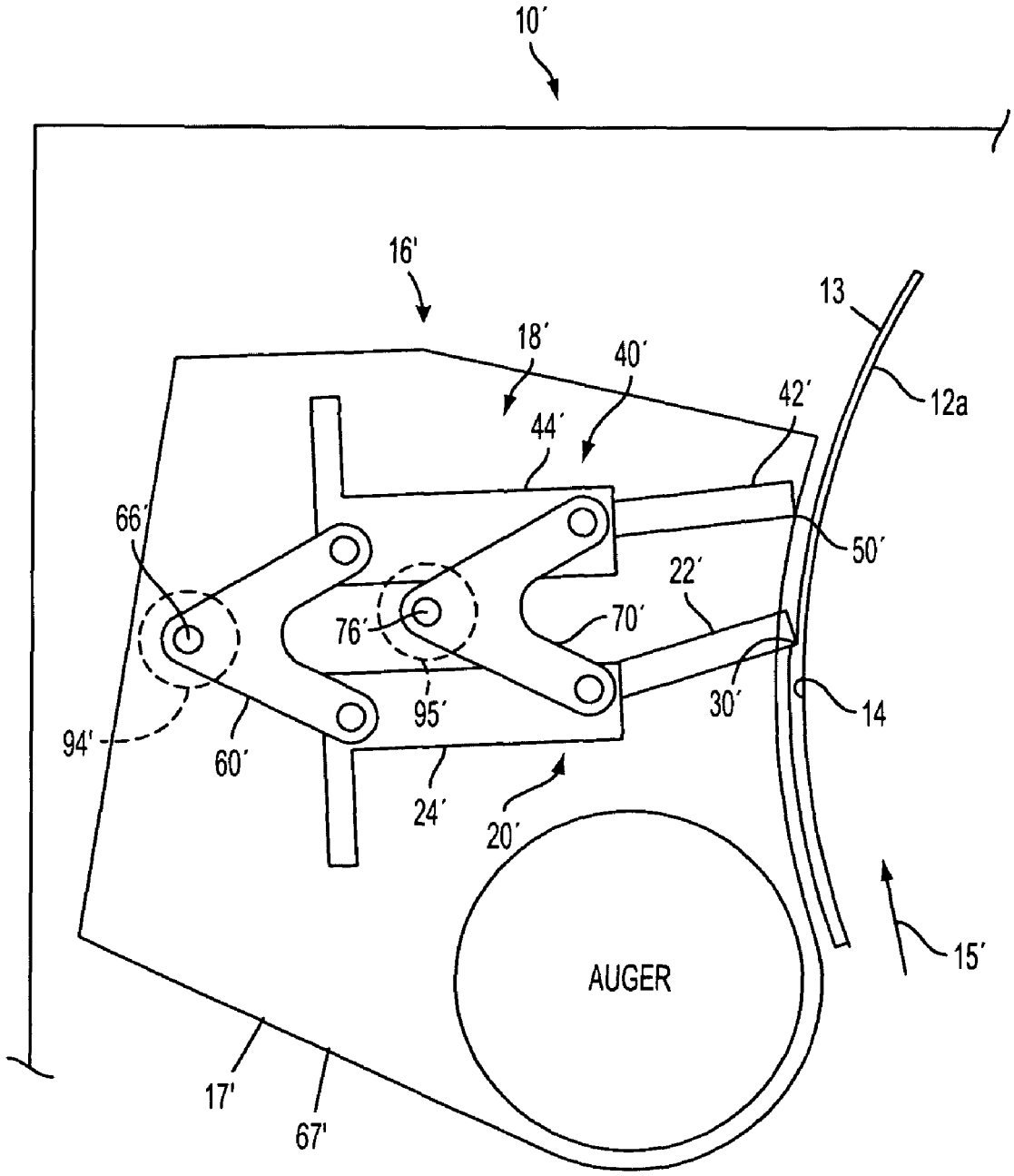
FIG. 5 is a perspective view illustrating the application apparatus having a wiper blade arrangement as described herein with a first blade disposed in the working position.
Figure 6:
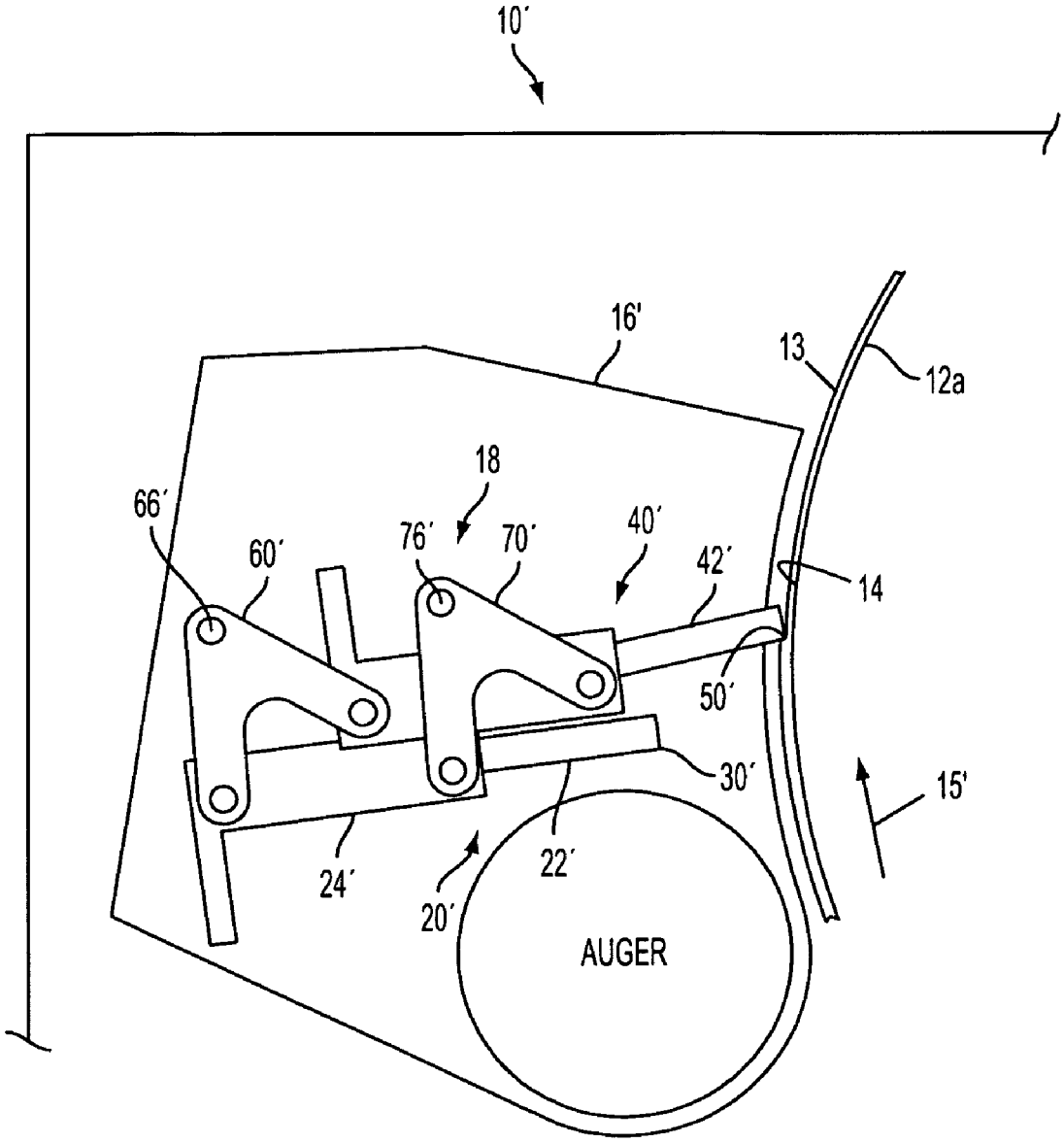
FIG. 6 is a perspective view illustrating the application apparatus having a wiper blade arrangement as described herein with a second blade disposed in the working position.

The blade engagement apparatus 16 can be provided in a doctor blade embodiment, as shown in FIGS. 1 and 2, wherein the blades 20, 40 are in a doctor blade orientation when disposed in the working position, referred to herein as $WP_{DB}$, as described in FIGS. 3 and 4. Alternatively, the blade engagement apparatus 16' can be provided in a wiper blade arrangement, as shown in FIGS. 5 and 6, wherein the blades 20' and 40' are in a wiper blade orientation when disposed in the working position, referred to herein as $WP_{WB}$, as described in reference to FIGS. 7 and 8.

As shown in FIG. 1, the first blade 20 is in the doctor blade working position $WP_{DB}$ such that the first blade member 20 engages the moving surface 14 in a doctor blade orientation. The second blade 40 is in its respective suspended position such that the metering tip 50 is separated from the moving surface 14, as shown. The actuator 94 moves the drive link rotating it about the third pivot connection thereby rotating the follower link about its corresponding third connection also, to move the first blade 20 from the $WP_{DB}$ to its respective suspended position as shown in FIG. 2. Simultaneously, the second blade 40 is moved from its suspended position into the same $WP_{DB}$ at the same location previously occupied by the first blade 20'.

Referring now to FIG. 3 the doctor blade orientation for blades 20 and 40 disposed in $WP_{DB}$ for a curved moving surface, such as a drum 12*a*, and for a flat rigid moving surface 12*b*, is shown generally at 300. For the purposes of this description, a tangent $T_{PR}$ is taken at curved moving surface which can be considered as being similar to the flat moving surface, both which are referred to as the moving surface 14. In $WP_{DB}$, the blade holder 24, 44 is oriented so that the blade holder angle (BHA)<90 degrees as defined from the downstream side of the metering tip 30, 50. BHA can be measured as the angle between $T_{ND}$ and $T_B$, where $T_{ND}$ extends along the undeflected downstream side of the blade member 22*b*, 42*b* (i.e. just as it extends from the rigid blade holder 24, 44) and $T_B$ is a tangent to the downstream side of the blade member taken at the metering tip 30 or 50.

In $WP_{DB}$, the blade 20 or 40 has been moved into engagement with the moving surface 14 with a predetermined pressure applied to the blade holder 24 or 44. The compliant blade member 22 or 42 is deflected by a predetermined blade deflection angle (BDA), which can be measured between $T_B$ and $T_{ND}$. The blade 20, 40 can thus be considered to be in deflected engagement with surface 14 while in any of the working positions described herein. In $WP_{DB}$, the blade member 20, 40 forms a working angle WA measured at the downstream side of the metering tip 30, 50 between $T_B$ and $T_{PR}$. In the example provided, BDA=BHA−WA. The WA can range from about 4 degrees to about 12 degrees, with other suitable ranges including from about 8 degrees to about 12 degrees. Other ranges can be used and the BDA range is chosen to provide a desired blade load for the chosen blade material. The modulus of the blade material, the blade thickness, the amount of extension of the blade member 22, 42 from the blade holder 24, 44 and the friction against the moving surface 14 determine the blade deflection, as measured by the BDA, required to obtain the desired blade load. The BHA is chosen to obtain both the desired BDA and WA. The blade loads can range from about 15 g/cm to about 60 g/cm with other suitable ranges including from about 25 g/cm to about 35 g/cm, though it should be appreciated that other blade load ranges can be achieved.

Referring now to FIG. 4 the doctor blade orientation for blades 20, 40 disposed in $WP_{DB}$ for a flexible moving surface 14, such as for example a flexible photoreceptor 12*c*, is shown generally at 400. BDA is measured in a similar manner as described above, as the angle between $T_B$ and $T_{ND}$. BHA is measured as the angle between $T_{ND}$ and $T_B$. WA is the angle between $T_B$ and $T_{PR}$.

The application apparatus 16 moves both blades 20 and 40 into the same $WP_{DB}$ at the same location in a mutually exclusive manner so only one blade occupies the working position at a time. In the working position, each blade forms the same BHA, BDA and WA applicable for the surfaces 14 described above.

During use, the operational blade 20 or 40, can be repeatedly moved out of the working position and into an operational standby position disengaged from the surface 14 such that the blade tip 30 or 50 is suspended therefrom, and then moved back into the working position in engagement with surface 14, by rotating the links 60 through a smaller range of angular motion than is required for the blade replacement procedure described above. The non-operational blade 40 or 20 can be moved between two non-operational suspended positions keeping the corresponding blade edge 50 or 30 separated from the surface 14. In this manner, the operational blade 20 or 40 can be moved into the working position for metering operations and then withdrawn into the operational standby position to prevent the blade from interfering with the moving surface 14 during other stages of the image forming process.

Referring now to FIGS. 5 and 6, an example of the image forming device, shown generally at 10', having a application apparatus with a wiper blade arrangement is shown generally at 16'. The wiper blade application apparatus 16' is similar to the doctor blade application apparatus 16 described above, with similar components referenced by like reference numerals using a (') to indicate the wiper blade distinction. As such, the application apparatus 16' includes first 60' and second links 70' disposed at each opposite lateral end of the blades 20' and 40', and connected thereto at first 62', 72' and second 64', 74' pivot connections similar to those described above. One or more actuators 94', 95', similar to those described above, are connected to at least one of the first or second links for rotating them about the third pivot connections 66', 76' thereby moving the blades between a single common working position $WP_{WB}$ and two separate, respective suspended positions.

In FIG. 5, the first blade 20' is in $WP_{WB}$ such that the first blade member metering tip 30' is in metering contact with the moving surface 14' in the wiper blade orientation. The second blade 40' is in its respective suspended position such that the metering tip 50' is separated from the moving surface 14' as shown. At the end of the useful operational life of the first blade 20', the actuator 94' moves the drive link 60' rotating it about the third pivot connection at an axis similar to axis A described above, thereby rotating the follower link about its corresponding third link at an axis similar to axis B described above, also, to move the first blade 20' from $WP_{WB}$ to its respective suspended position as shown in FIG. 6. The second blade 40' is simultaneously moved from its suspended position into the $WP_{WB}$ at the same location previously occupied by the first blade 20'.

Figure 7:
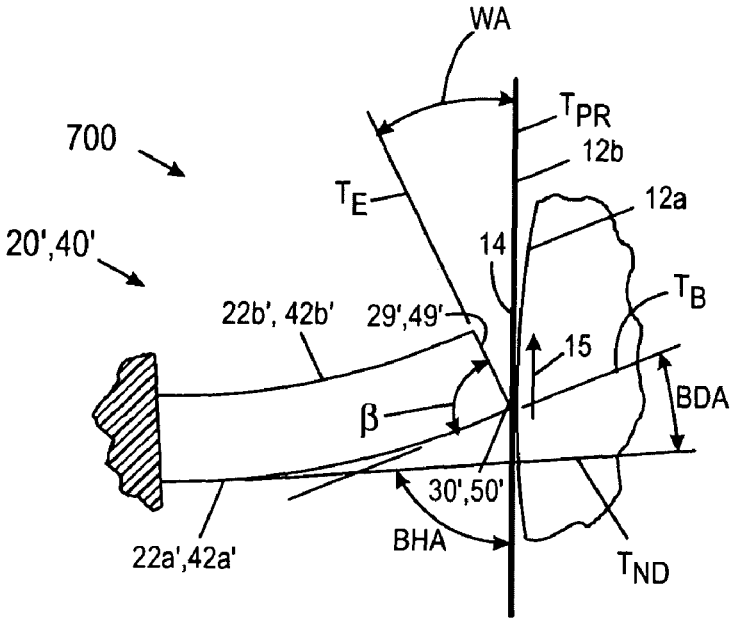
FIG. 7 illustrates the wiper blade orientation of the first and second blades disposed in the working position against flat and cylindrical moving surfaces.

Referring now to FIG. 7 the wiper blade orientation for blades 20' and 40' disposed in $WP_{WB}$ for a curved moving surface 14', such as a drum photoreceptor 12*a*', and a flat moving surface 14', such as a flat rigid photoreceptor 12*b*', is shown generally at 700. Tangents $T_{PR}$, $T_B$, and $T_{ND}$ are similar to those described above are used. In $WP_{WB}$, the blade holder 24', 44' is oriented so that BHA<90 degrees as defined from the upstream side of the metering tip 30', 50'. BHA can be measured as the angle between $T_{ND}$ and $T_{PR}$ as shown.

In $WP_{WB}$, the blade 20' or 40' has been moved into deflected engagement with the moving surface 14' with a predetermined pressure applied to the blade holder 24' or 44'. The compliant blade member 22' or 42' is deflected by a predetermined BDA, which can be measured between $T_B$ and $T_{ND}$. In $WP_{WB}$, the blade member 20', 40' forms a working angle WA measured at the downstream side of the metering tip 30', 50' between a tangent to the end of the blade member $T_E$ and $T_{PR}$ as shown. In the example provided, BDA=BHA−WA. Similar ranges to those described above are suitable.

Figure 8:
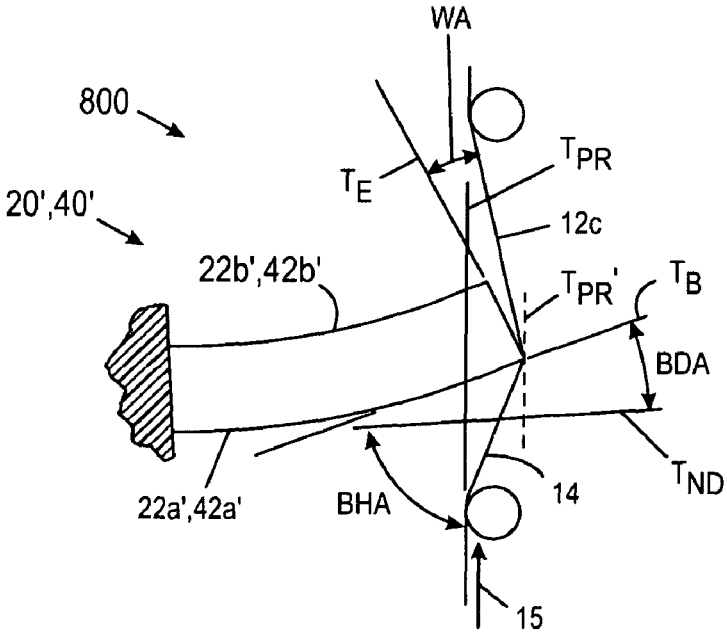
FIG. 8 illustrates the wiper blade orientation of the first and second blades disposed in the working position against a moving belt.

Referring now to FIG. 8 the wiper blade orientation for blades 20', 40' disposed in $WP_{WB}$ for a flexible photoreceptor 12*c*' having a flexible moving surface 14' is shown generally at 800. BDA is measured in a similar manner as described above, as the angle between $T_B$ and $T_{ND}$. BHA is measured as the angle between $T_{ND}$ and $T_B$. WA is the angle between $T_E$ and $T_{PR}$.

The application apparatus 16' moves both blades 20' and 40' into the same $WP_{WB}$ at the same location in a mutually exclusive manner so only one blade occupies the location at a time, so as to form the same BHA, BDA and WA for both blades. This is applicable for the moving surfaces 14' described above.

The interaction of the compliant blade 20, 40 (20', 40') in deflected engagement with the moving surface 14 (14') in the working positions ($WP_{DB}$, $WP_{WB}$) described above can be referred to generally as blade interference. The blade interference can be considered a measure of how far the blade tip 30, 50 (30', 50') would extend into the surface 14 (14') if the blade member 22, 42 (22', 42') did not deflect as described. While the blade 20, 40 (20', 40') is in the working position ($WP_{DB}$, $WP_{WB}$), the blade positioning mechanism 18, 18' can be actuated to move the blade in a direction towards the surface 14 (14') to increase the blade interference, increase the blade deflection, and increase the blade load at the blade tip 30, 50 (30', 50') on the surface for metering a thinner layer of release agent onto the surface. Further, the blade positioning mechanism 18, 18' can also be actuated, using a second direction of actuation, to move the blade 20, 40 (20', 40') in a direction away from the surface 14 (14') while the blade is in the working position to decrease the blade interference, decrease the blade deflection, and decrease the blade load at the blade tip 30, 50 (30', 50') on the surface for metering a thicker layer of release agent onto the surface.

The application apparatus 16 (16') uses first and second three-pivot links 60, 70 (60', 70') to couple the first and second blades 20, 40 (20', 40') together to provide accurate and repeatable positioning of both blades 20, 40 (20', 40') into a single working position $WP_{DB}$ ($WP_{WB}$). The blade not occupying the working position is moved into one of two respective suspended positions. The application apparatus 16 (16') provides a compact dual blade arrangement which can effectively more than double the useful life of the application apparatus as compared to those using a single metering blade.

The application apparatus 16 (16') is configured to allow simplified replacement of blades 22, 42 (22', 42'). As the end of life of an operating blade is reached, the used blade 22 (22') or 42 (42') is withdrawn from contact with the moving surface 14 (14') and the second blade is placed into operation in the working position. The life of the application apparatus 16 (16') between service intervals required for replacement of used blades is therefore extended with high reliability to more than twice the life of a conventional single blade system.

Blade changes can be initiated base on accumulated blade use, or blade failure identified by a failure sensor or the customer. Failure sensors can detect metering failures on the photoreceptor before they appear on prints leading to blade replacements before customers are aware of faults, or sensors can sense for streaks on image prints signaling the need for blade changes at first sign of sensing defects. Sensors can be used to monitor for streaks on output prints or on moving surface 14 and actuator 94 can provide incremental bi-directional changes in rotation to links 60 to make small changes in the blade load to achieve a minimum blade load needed for preventing streaks during image forming, as disclosed in the co-pending application U.S. application Ser. No. 12/201,140 filed concurrently herewith, entitled "SYSTEM AND METHOD OF ADJUSTING BLADE LOADS FOR BLADES ENGAGING IMAGE FORMING MACHINE MOVING SURFACES" the disclosure of which was previously is incorporated herein by reference in its entirety.

If the application apparatus 16 (16') is contained within a cartridge 17, the system can be easily replaced. The two blade application apparatus life would therefore be matched to the expected life of the other DMU components. Changing from a conventional single blade to the two blade application apparatus 16 (16') will enable a long life DMU more suitable for use with the overcoated photoreceptor.

If the application apparatus 16 (16') is directly mounted into the machine bases 67, replacement can be independent of the other imaging machine elements. When both blades 20, 40 (20', 40') have been used, the application apparatus can be replaced as a single unit. Alternatively, new blades 20, 40 (20' 40') can be mounted to the links 60, 70 (60', 70').

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A application apparatus for applying a release agent to a moving surface in image forming device, the application apparatus comprising:

a first blade having a blade member;

a second blade having a blade member;

a first link having a rigid body with three pivot connections including a first pivot connection pivotally connected to the first metering blade, a second pivot connection pivotally connected to the second metering blade, and a third pivot connection;

an actuator connected to the first link for pivoting the first link about the third pivot connection for moving the first blade between a working position at a first location wherein the blade member is in a deflected working position in metering contact with a moving surface and a suspended position wherein the blade member is separated from the moving surface; and a second link having a rigid body with three pivot connections including a third pivot connection, a first pivot connection pivotally connected to the first blade for pivoting the second link about the third pivot connection as the first blade is moved, and a second pivot connection pivotally connected to the second blade assembly for moving the second blade between a suspended position wherein the blade member is separated from the moving surface and the working position at the first location wherein the blade member is in deflected engagement with the moving surface.

2. The application apparatus of claim 1 wherein the first link pivot connections are disposed in triangular arrangement and the second link pivot connections are disposed in triangular arrangement.

3. The application apparatus of claim 1 further comprising a base member pivotally connected to the first link at the third pivot connection for preventing non-pivoting displacement of the first link relative to the base member.

4. The application apparatus of claim 3 wherein the base member is a replaceable print cartridge or a replaceable cleaner cartridge connected to the image forming system to prevent non-pivoting displacement of the first link relative to the image forming system.

5. The application apparatus of claim 1 wherein the moving surface is a transfer surface.

6. The application apparatus of claim 1 further comprising:

the first blade having a first lateral end proximate portion disposed adjacent the moving surface and connected to the first pivot connection of the second link and a first lateral end distal portion disposed opposite the proximate portion connected to the first pivot connection of the first link; and the second blade having a first lateral end proximate portion disposed adjacent the moving surface connected to the second pivot connection of the second link and a distal portion disposed opposite the proximate portion connected to the second pivot connection of the first link.

7. The application apparatus of claim 6 further comprising a second pair of first and second links connected to second lateral ends of the first and second blades.

8. The application apparatus of claim 1 further comprising:

the first blade having a rigid blade holder and a compliant blade member extending from the blade holder, the blade member terminating in an end having a metering tip for engaging the moving surface for metering; and the second blade having a rigid blade holder and a compliant blade member extending from the blade holder, the blade member terminating in an end having a metering tip for engaging the moving surface for metering.

9. The application apparatus of claim 1 wherein the first and second blades are doctor blades disposed in a doctor blade orientation in the working position.

10. The application apparatus of claim 9 wherein the first and second blades have similar blade holder angles, blade deflection angles and Working Angles when in the working position.

11. The application apparatus of claim 1 wherein the first and second blades are wiper blades disposed in a wiper blade orientation in the working position.

12. The application apparatus of claim 11 wherein the first and second blades define similar blade holder angles, blade deflection angles and Working Angles when disposed in the working position.

13. An image forming device comprising:

a moving surface;

first compliant blade including a compliant portion terminating in a metering tip;

a second blade including a compliant portion terminating in a metering tip;

first and second links pivotally connecting first lateral ends of the first and second blades together for mutually exclusive cooperative movement alternating between a common working position at a first location wherein a blade is in deflected engagement with the moving surface for metering the release agent onto the moving surface between the respective metering tip and the moving surface and separate respective suspended positions not engaging the moving surface.

14. The image forming device of claim 13 wherein the first link includes three pivot connections disposed in a triangular arrangement and the second link includes three pivot connections disposed in a triangular arrangement.

15. The image forming device of claim 13 wherein the first and second blades are doctor blades disposed in a doctor blade orientation in the working position.

16. The image forming device of claim 13 wherein the first and second blades are wiper blades disposed in a wiper blade orientation in the working position.

17. The image forming device of claim 13 further comprising:

a second pair of first and second links pivotally connecting second lateral ends, disposed opposite the first lateral ends, of the first and second blades together the cooperative movement.

18. The image forming device of claim 13 wherein the first and second links each include three pivot connections arranged in a triangle.

19. The application apparatus of claim 13 wherein the moving surface is a transfer surface.

20. A replaceable release agent application cartridge for an image forming device having a moving surface comprising:

a first blade having a blade member;

a second blade having a blade member;

a first link having a rigid body with three pivot connections including a first pivot connection pivotally connected to the first metering blade, a second pivot connection pivotally connected to the second metering blade, and a third pivot connection;

an actuator connected to the first link for pivoting the first link about the third pivot connection for moving the first blade between a working position at a first location wherein the blade member is in deflected engagement with a moving surface and a suspended position wherein the blade member is separated from the moving surface; and a second link having a rigid body with three pivot connections including a third pivot connection, a first pivot connection pivotally connected to the first blade for pivoting the second link about the third pivot connection as the first blade is moved, and a second pivot connection pivotally connected to the second blade assembly for moving the second blade between a suspended position wherein the blade member is separated from the moving surface and the working position at the first location wherein the blade member is in deflected engagement with the moving surface for metering release agent onto the moving surface.

* * * * *